US006715827B1

(12) United States Patent
Chen

(10) Patent No.: US 6,715,827 B1
(45) Date of Patent: Apr. 6, 2004

(54) BACKREST ADJUSTING MECHANISM USED IN HIGH CHAIR FOR INFANTS, TODDLERS, AND SMALL CHILDREN

(75) Inventor: Shun-Min Chen, Taipei Hsien (TW)

(73) Assignee: Kenny Cheng, Tapei (TW)

( * ) Notice: Subject to any disclaimer, the term of this patent is extended or adjusted under 35 U.S.C. 154(b) by 0 days.

(21) Appl. No.: 10/262,236

(22) Filed: Oct. 1, 2002

(51) Int. Cl.[7] ..... A47C 83/02

(52) U.S. Cl. ..... 297/148; 297/344.14; 297/344.18; 297/61; 297/423.3; 297/273

(58) Field of Search ..... 297/148, 344.14, 297/344.18, 367, 61, 423.3, 149, 153, 16.1, 16.2, 273

(56) References Cited

U.S. PATENT DOCUMENTS

| | | | | | |
|---|---|---|---|---|---|
| 4,065,175 | A | | 12/1977 | Perego | 297/423.1 X |
| 5,165,755 | A | * | 11/1992 | Rho | 297/344.18 |
| 5,445,432 | A | * | 8/1995 | Chien | 297/344.14 X |
| 5,489,138 | A | | 2/1996 | Mariol et al. | 297/344.14 X |
| 5,507,550 | A | * | 4/1996 | Maloney | 297/344.14 X |
| 5,810,432 | A | | 9/1998 | Haut et al. | 297/153 |
| 5,820,207 | A | * | 10/1998 | Wang | 297/148 X |
| 5,951,102 | A | * | 9/1999 | Poulson et al. | 297/344.14 X |
| 6,082,814 | A | | 7/2000 | Celestina-Krevh et al. | 297/153 X |
| 6,126,236 | A | * | 10/2000 | Wu | 297/148 X |
| 6,161,898 | A | * | 12/2000 | Brevi | 297/344.14 X |
| 6,347,773 | B1 | | 2/2002 | Gross et al. | 248/176.1 |
| 6,419,312 | B1 | * | 7/2002 | Flannery et al. | 297/148 X |

* cited by examiner

*Primary Examiner*—Peter R. Brown
*Assistant Examiner*—Rodney B. White
(74) *Attorney, Agent, or Firm*—Gauthier & Connors LLP

(57) ABSTRACT

Disclosed is a backrest adjusting mechanism used in a high chair for infants, toddlers and small children and installed in the hollow section of the backrest body of the high chair, which includes a fixed handle, a movable handle, a set of springs, a movable rod, and a horizontal lever for adjusting the inclination angle of the backrest portion of the high chair, in which the springs are connected between the movable rod and the movable handle. The backrest adjusting mechanism is characterized in that a first groove is formed in each of the two bottom sides of the movable rod of the backrest adjusting mechanism, and a second groove is formed in each of the two bottom sides of the backrest body, and said horizontal lever penetrates through the bottom of the backrest body and communicates to said first and second grooves. When the inclination angle of the backrest portion is intended to be adjusted, the movable handle is pulled to jointly drag the movable rod so that the horizontal lever can be released from the position where it is previously hold. At this point, the inclination angle of the backrest portion can be adjusted. When the desired inclination angle is reached, the backrest portion of the high chair can be easily fixed at this desired inclination position by simply releasing the movable handle. In this way, the backrest portion of the high chair can be adjusted at will.

9 Claims, 9 Drawing Sheets

BACKREST ADJUSTING MECHANISM USED IN HIGH CHAIR FOR INFANTS, TODDLERS, AND SMALL CHILDREN

BACKGROUND OF THE INVENTION

1. Field of the Invention

The present invention relates to a backrest adjusting mechanism used in a high chair for infants, toddlers and small children and more particularly, to a backrest adjusting mechanism used in a high chair for infants, toddlers and small children, in which the inclination angle of the backrest and the height of a seat are both adjustable, and a high chair for infants, toddlers and small children equipped with such a backrest adjusting mechanism.

2. Description of the Related Art

It is quite common to use a high chair for infants, toddlers and small children. Generally, the construction of a conventional high chair for infants, toddlers and small children mainly consists of a leg structure portion and a seat portion, for example, as specified in the U.S. Pat. Nos. 5,810,432, 6,082,814, 5,489,138, 6,347,773, and 4,065,175. However, the high chairs disclosed in those patents are not optimally designed. For example, in some cases, the inclination angle of the backrest of the high chair or the height of the seat of the high chair cannot be adjusted, or otherwise, although the high chair has the above functions, it is not easy to be operated and used in design, or a relative large storing or accommodating space is required when the high chair is retracted.

Therefore, to overcome the defects of the conventional high chairs described above, the present invention makes an improvement on the design of the conventional high chairs and provides a backrest adjusting mechanism used in a high chair for infants, toddlers and small children, which offers inclination angles adapted for the infants, toddlers and small children to eat, play and sleep in such a high chair.

SUMMARY OF THE INVENTION

An object of the present invention is mainly to provide a backrest adjusting mechanism used for a high chair for infants, toddlers and small children, which makes a further implementation particularly with respect to the defects of the conventional high chair for infants, toddlers and small children in order to produce a novel high chair for infants, toddlers and small children equipped with such a backrest adjusting mechanism having advantages of both the height of the seat portion and the inclination angle of the backrest portion of the high chair being adjustable, the usage and operation thereof being feasible, and being fully retractable.

In accordance with one aspect of the present invention, there is provided a high chair for infants, toddlers and small children equipped with a backrest adjusting mechanism primarily comprising a leg portion and a seat portion, the leg portion including a pair of front legs, a pair of rear legs, a pair of horizontal connecting members, and a set of joining members, wherein a plurality of positioning holes are formed in and a stopper component is provided on each of the front legs for adjusting the height position of the seat portion of the high chair, and the seat portion movably joined to said leg portion and comprising a backrest portion including a backrest body, a pair of backrest side panels, and a headrest panel, wherein the headrest panel is pivotally connected to the top of the backrest body, one end of each of the backrest side panels is connected to a respective side of the headrest panel, and the other end of each of the backrest side panels is connected to a respective side panel of the height-adjusting device and side panel portions, and wherein a hollow section is provided in the middle portion of the backrest body for the installation of the backrest adjusting mechanism, and a locating slot is formed in each of the two bottom sides of the backrest body for adjusting the inclination angle of the backrest portion; a seat body; a foot rest pivotally connected to a lower bending portion of the seat body; a pair of arm rests, wherein one end of each of the arm rests is pivotally connected to one of the side panels of the height-adjusting device and side panel portions such that each of the arm rests can be moved upwardly for retraction; a pair of height-adjusting device and side panel portions movably joined to a respective one of the front legs of the leg portion, and each of the height-adjusting device and side panel portions including a side panel portion and a height-adjusting device , wherein said height-adjusting device is comprised of a button, a fixed sheet, a movable sheet, a spring, and a pin for adjusting the height position of the seat portion of the high chair, and wherein the pin is secured to a rear portion of the movable sheet, and the spring is connected between the fixed sheet and the movable sheet; and a backrest adjusting mechanism installed in the hollow section of the backrest body and comprised of a fixed handle, a movable handle, a set of springs, a movable rod, and a horizontal lever for adjusting the inclination angle of the backrest portion of the high chair, wherein the springs are connected between the movable rod and the movable handle, and wherein a first groove is formed in each of the two bottom sides of the movable rod of the backrest adjusting mechanism, a second groove is formed in each of the two bottom sides of the backrest body, and the horizontal lever penetrates through the bottom of the backrest body and communicates to the first and second grooves.

There is provided a high chair for infants, toddlers and small children equipped with a backrest adjusting mechanism in accordance with the present invention, wherein the operation of the height-adjusting device is to press the button such that the pin can be separated from the positioning hole at which it is fixed, and whereby the height-adjusting device can be moved along the front leg of the leg portion upwardly and downwardly so as to adjust the height of the seat portion of the high chair.

There is provided a high chair for infants, toddlers and small children equipped with a backrest adjusting mechanism in accordance with the present invention, wherein the operation of the backrest adjusting mechanism is to pull the movable handle to jointly drag the movable rod so that the horizontal lever can be released from the position where it is previously held, and whereby the backrest portion of the high chair can be adjusted as desired.

In accordance with the other aspect of the present invention, there is provided a backrest adjusting mechanism used in a high chair for infants, toddlers and small children and installed in the hollow section of the backrest body of the high chair, which includes a fixed handle, a movable handle, a set of springs, a movable rod, and a horizontal lever for adjusting the inclination angle of the backrest portion of the high chair, in which the springs are connected between the movable rod and the movable handle. The backrest adjusting mechanism is characterized in that a first groove is formed in each of the two bottom sides of the movable rod of the backrest adjusting mechanism, and a second groove is formed in each of the two bottom sides of the backrest body, and said horizontal lever penetrates through the bottom of the backrest body and communicates to said first and second grooves. When the inclination angle of the backrest portion is intended to be adjusted, the movable handle is pulled to jointly drag the movable rod so that the horizontal lever can be released from the position where it is previously held. At this point, the inclination angle of the backrest portion can be adjusted. When the desired inclination angle is reached, the backrest portion of the high chair can be easily fixed at this desired inclination position by simply releasing the movable handle. In this way, the backrest portion of the high chair can be arbitrarily adjusted.

BRIEF DESCRIPTION OF THE DRAWINGS

The accompanying drawings, which are incorporated in and constitute a part of this specification, illustrate a preferred embodiment of the invention and, together with a general description of the invention given above, and the detailed description of the embodiment given below, serve to explain the principle of the invention, in which.

DETAILED DESCRIPTION OF A PREFERRED EMBODIMENT

An embodiment in accordance with the present invention will be described hereinafter with reference to the accompanying drawings by exemplifying a high chair for infants, toddlers and small children.

Figure 1:
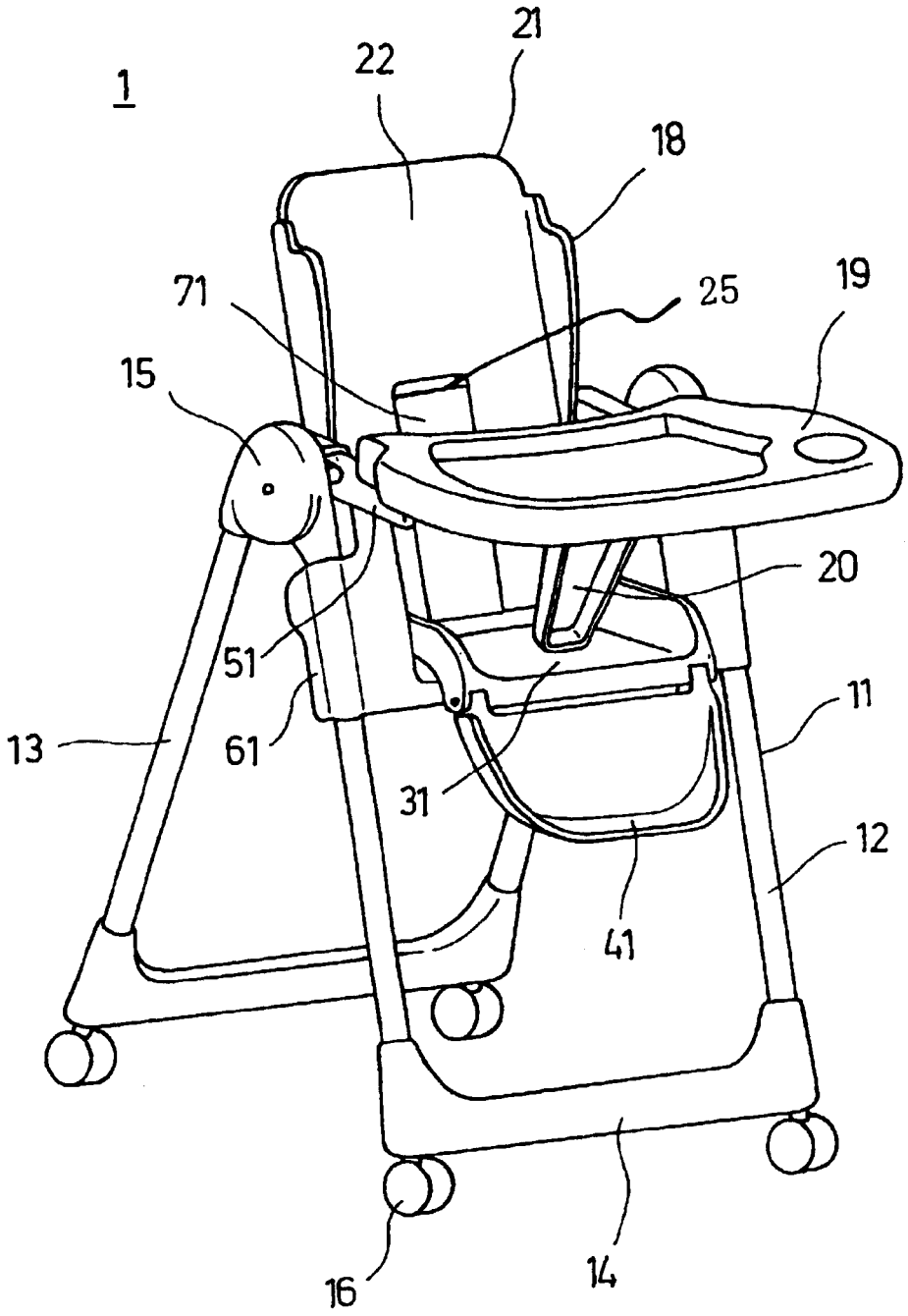
FIG. 1 is a perspective view of a high chair for infants, toddlers and small children in accordance with the present invention.
Figure 2:
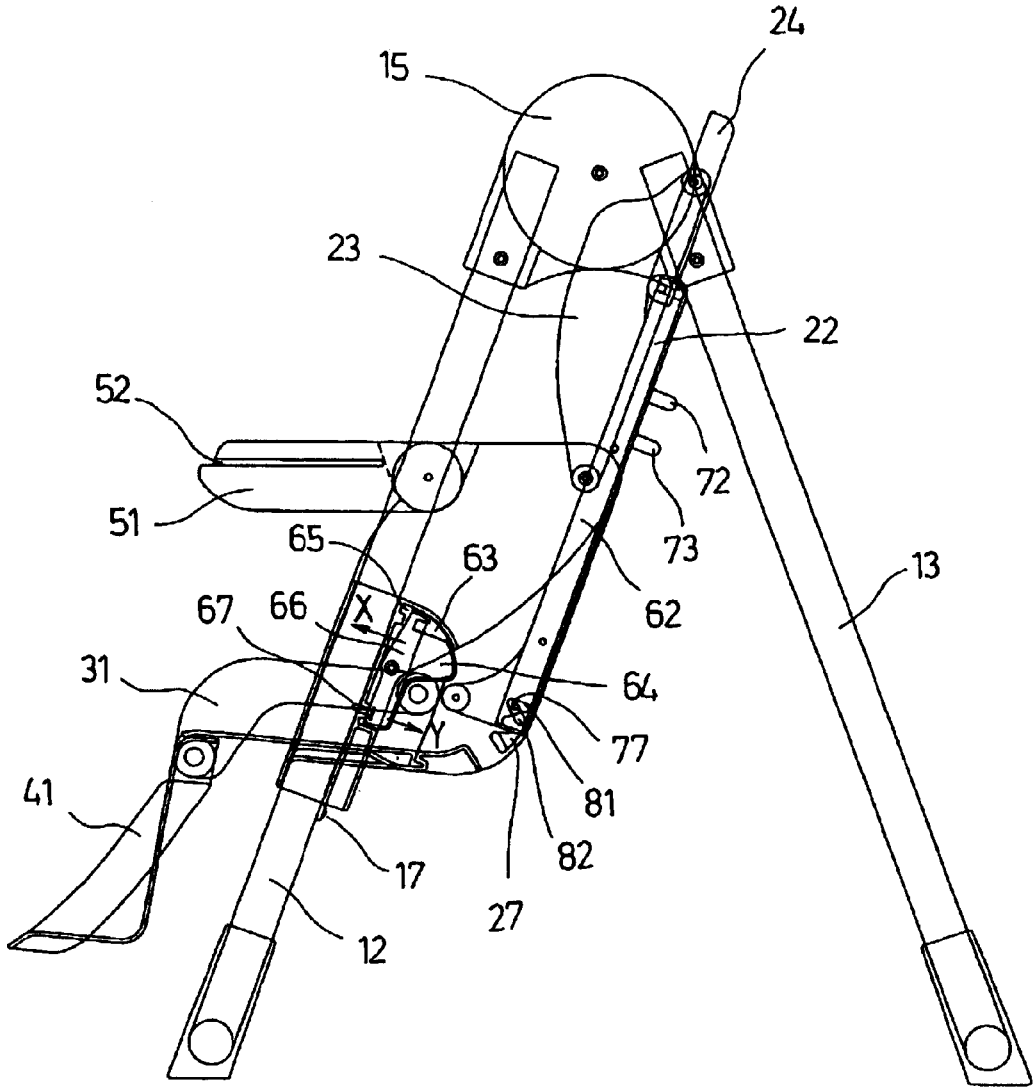
FIG. 2 is a side view of showing the structure of the high chair for infants, toddlers and small children in accordance with the present invention, in which the seat portion is in the lowest height position and the backrest is in the first adjusting position.

FIG. 1 is a perspective view of a high chair for infants, toddlers and small children in accordance with the present invention, and FIG. 2 is a side view of showing the structure of the high chair for infants, toddlers and small children in accordance with the present invention. Because the high chair for infants, toddlers and small children in accordance with the present invention is substantially symmetric with respect to its left side and right side, the description is only made with respect to one side of the structure of the high chair.

As shown in FIG. 1, a high chair 1 for infants, toddlers and small children in accordance with the present invention primarily comprises a leg portion 11 and a seat portion 18.

With reference to FIGS. 1 and 2, the leg portion 11 is comprised of a pair of front legs 12, a pair of rear legs 13, a pair of horizontal connecting members 14, and a set of joining members 15. One end of each of the front legs is connected with each other by one of the horizontal connecting members, and one end of each of the rear legs is connected with each other by the other horizontal connecting member. The other end of each of the front legs is connected to the other end of each of the rear legs by one of the joining members 15. In addition, each of the two ends of the horizontal connecting members of the leg portion 11 is equipped with a roller device 16 for the movement of the high chair 1. A plurality of positioning holes (not shown) are formed in and a stopper component 17 is provided on each of the front legs 12 for adjusting the height position of the seat portion 18 of the high chair 1 (will be described in detail later).

The seat portion 18 is comprised of a backrest portion 21, a seat body 31, a foot rest 41, a pair of arm rests 51, a pair of height-adjusting device and side panel portions 61, and a backrest adjusting mechanism 71.

The backrest portion 21 is comprised of a backrest body 22, a pair of backrest side panels 23, and an upper panel 24 for head rest. A hollow section 25 is provided in the middle portion of the backrest body 22 for receiving the backrest adjusting mechanism 71. Furthermore, a locating slot 27 in the form of an almost W shape is formed in each of the two bottom sides of the backrest body 22 for adjusting the inclination angle of the backrest portion 21 (will be described in detail later). The headrest panel 24 is pivotally connected to the top of the backrest body 22. One end of each of the backrest side panels 23 is respectively connected to one of the two sides of the headrest panel 24, and the other end of each of the backrest side panels 23 is respectively connected to one of the side panels of the height-adjusting device and side panel portions 61.

A lower bending portion of the seat body 31 is pivotally connected to the foot rest 41, and the lateral portions thereof are fixed to the height-adjusting device and side panel portions 61.

One end of each of the arm rests 51 is pivotally connected to one of the side panels of the height-adjusting device and side panel portions 61 such that each of the arm rests 51 can be moved upwardly for the purpose of retraction. The other end of each of the arm rests 51 is formed with a guide groove 52 for receiving a tray 19 for placing foods and toys (with reference to FIG. 1), in which a blocking member 20 is configured to extend downwardly from the bottom of the tray 19 so as to prevent infants, toddlers and small children from slipping out of the seat portion 18.

Each of the height-adjusting device and side panel portions 61 is movably joined to respective one of the front legs 12 of the leg portion 11, and is comprised of a side panel portion 62 and a height-adjusting device 63. The height-adjusting device 63 is comprised of a button 64, a fixed sheet 65, a movable sheet 66, a spring (not shown), and a pin 67 for adjusting the height position of the seat portion 18 of the high chair 1. The pin 67 is fixed to the rear portion of the movable sheet 66, and the spring is connected between the fixed sheet 65 and the movable sheet 66.

The backrest adjusting mechanism 71 is installed in the hollow section 25 of the middle portion of the backrest body 22 and is comprised of a fixed handle 72, a movable handle 73, a horizontal lever 77, a set of springs, and a movable rod (will be described in detail later) for adjusting the inclination angle of the backrest portion 21 of the high chair 1. The springs are connected between the movable rod and the movable handle 73. A first groove 81 is formed in each of the two bottom sides of the movable rod of the backrest adjusting mechanism 71, and a second groove 82 is formed in each of the two bottom sides of the backrest body 22. The horizontal lever 77 penetrates through the bottom of the backrest body 22 and communicates to the first and second grooves 81 and 82.

With reference to FIG. 2 to FIG. 9, the operation of the high chair for infants, toddlers and small children in accordance with the present invention will be explained in the following.

Figure 3:
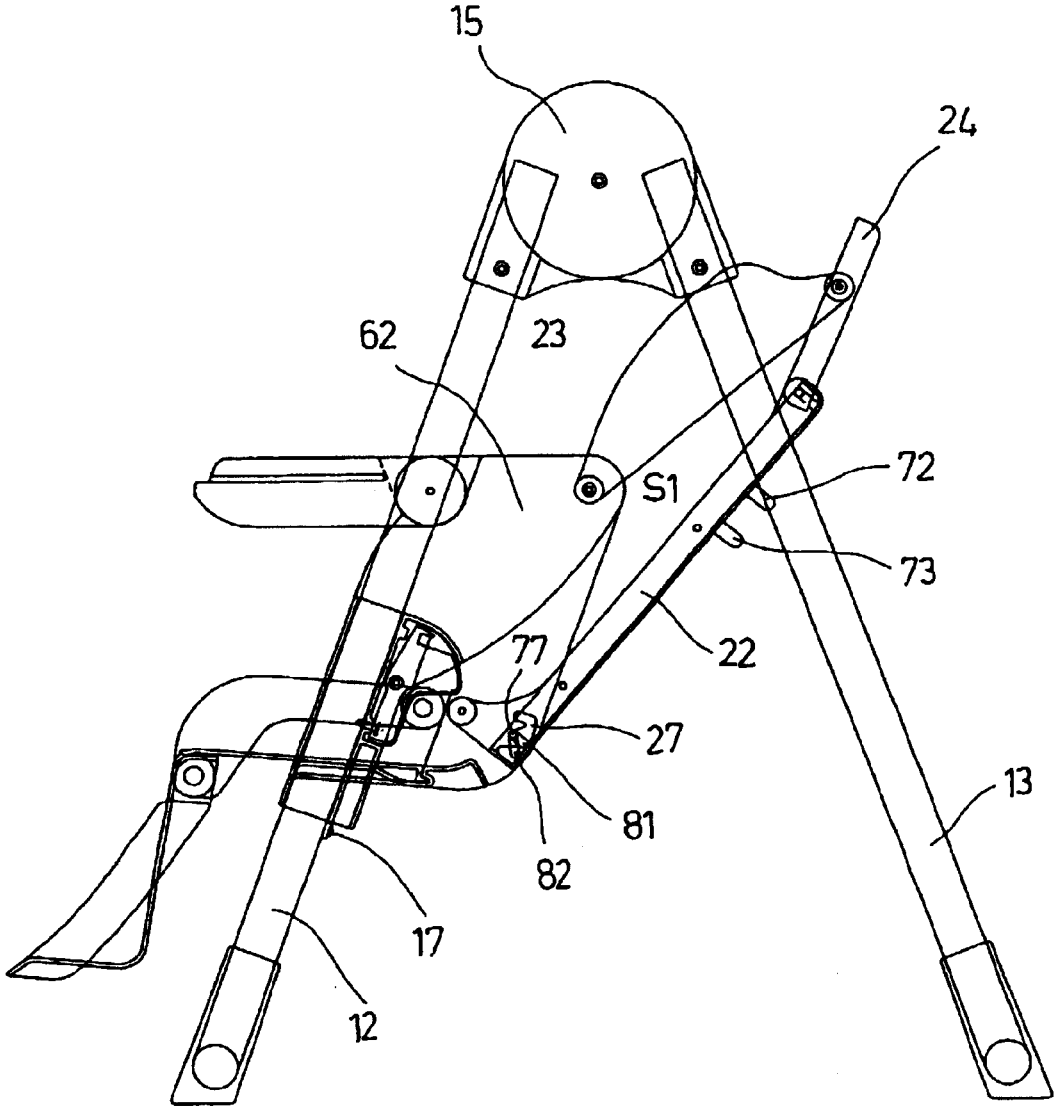
FIG. 3 is a side view of showing the structure of the high chair for infants, toddlers and small children in accordance with the present invention, in which the seat portion is in the lowest height position and the backrest is in the second adjusting position.
Figure 4:
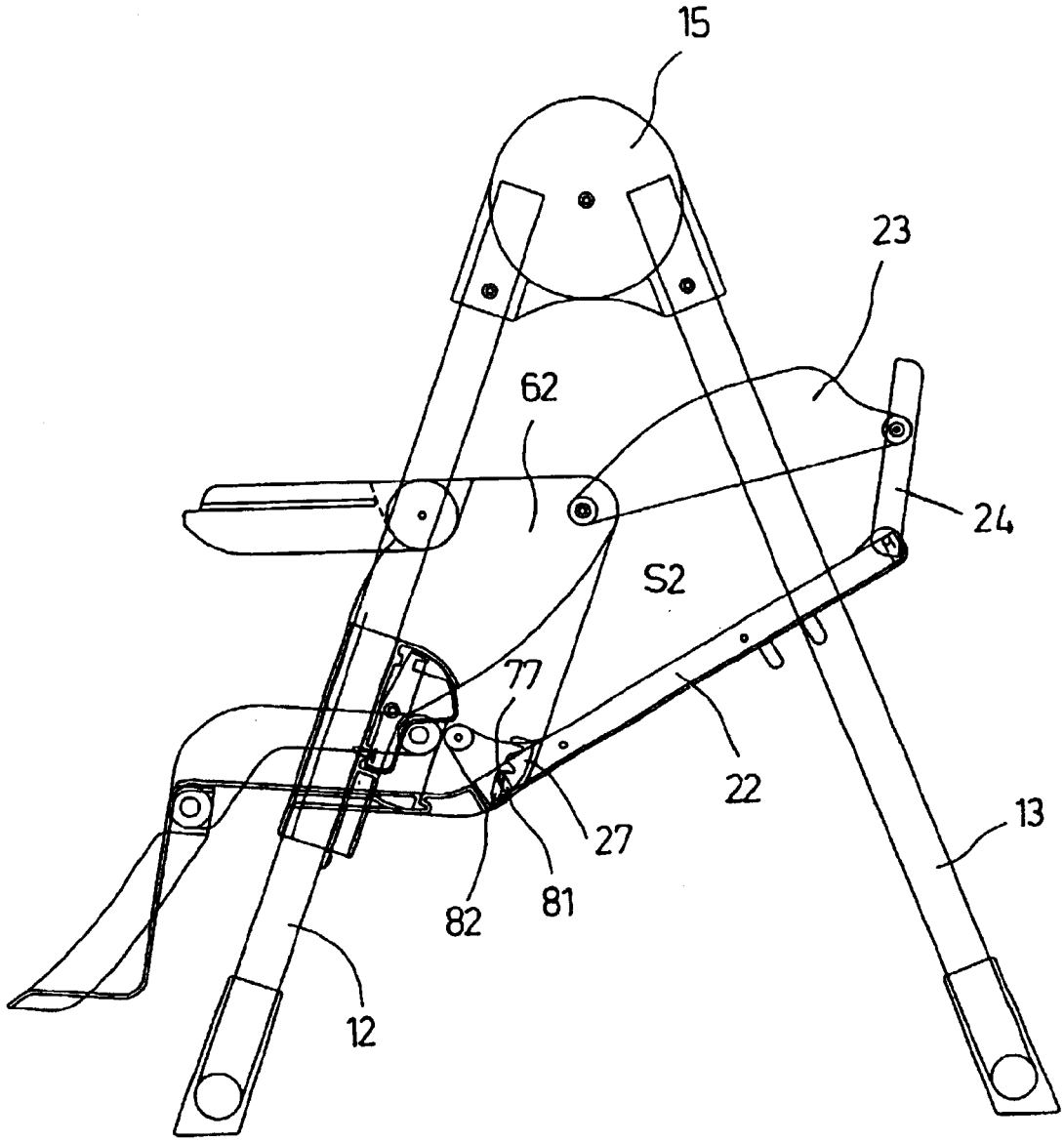
FIG. 4 is a side view of showing the structure of the high chair for infants, toddlers and small children in accordance with the present invention, in which the seat portion is in the lowest height position and the backrest is in the third adjusting position.

FIG. 2 to FIG. 4 are side views for showing the structure of the high chair for infants, toddlers and small children, in which the seat portion 18 is in the lowest height position and the backrest portion 21 is in the first, second and third adjusting positions, respectively.

Figure 5:
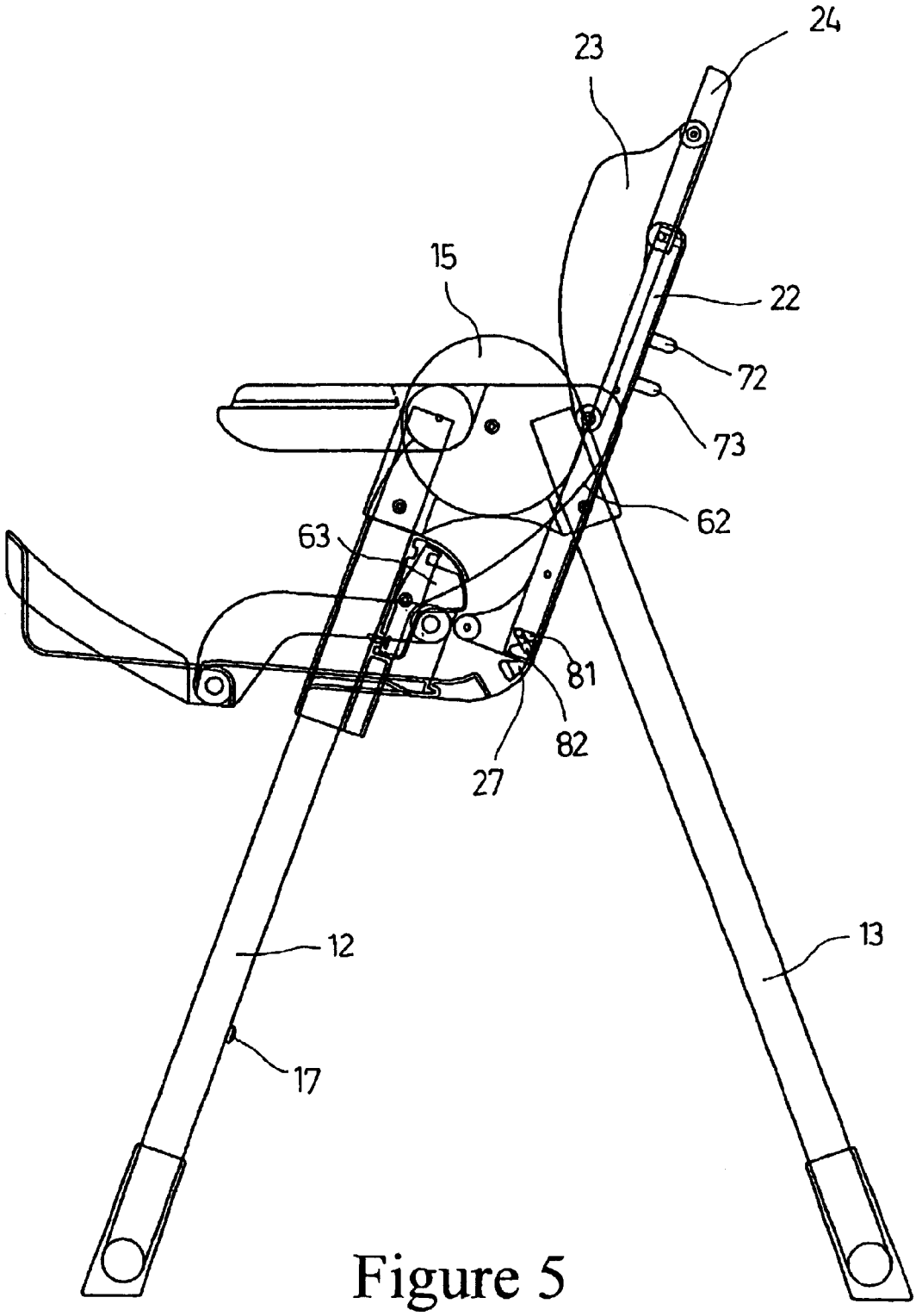
FIG. 5 is a side view of showing the structure of the high chair for infants, toddlers and small children in accordance with the present invention, in which the seat portion is in the highest height position and the seat portion is in the first adjusting position.
Figure 6:
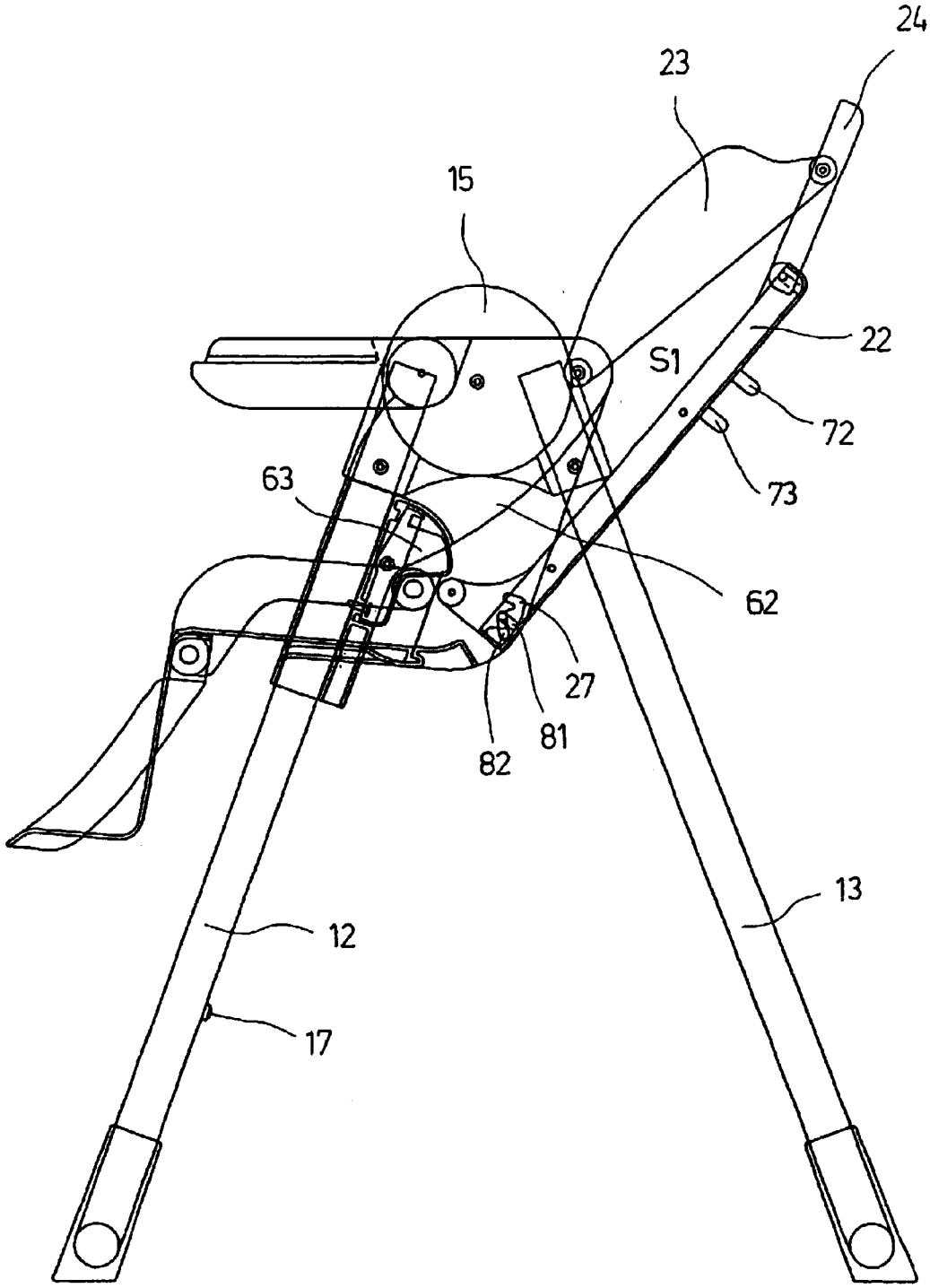
FIG. 6 is a side view of showing the structure of the high chair for infants, toddlers and small children in accordance with the present invention, in which the seat portion is in the highest height position and the backrest is in the second adjusting position.
Figure 7:
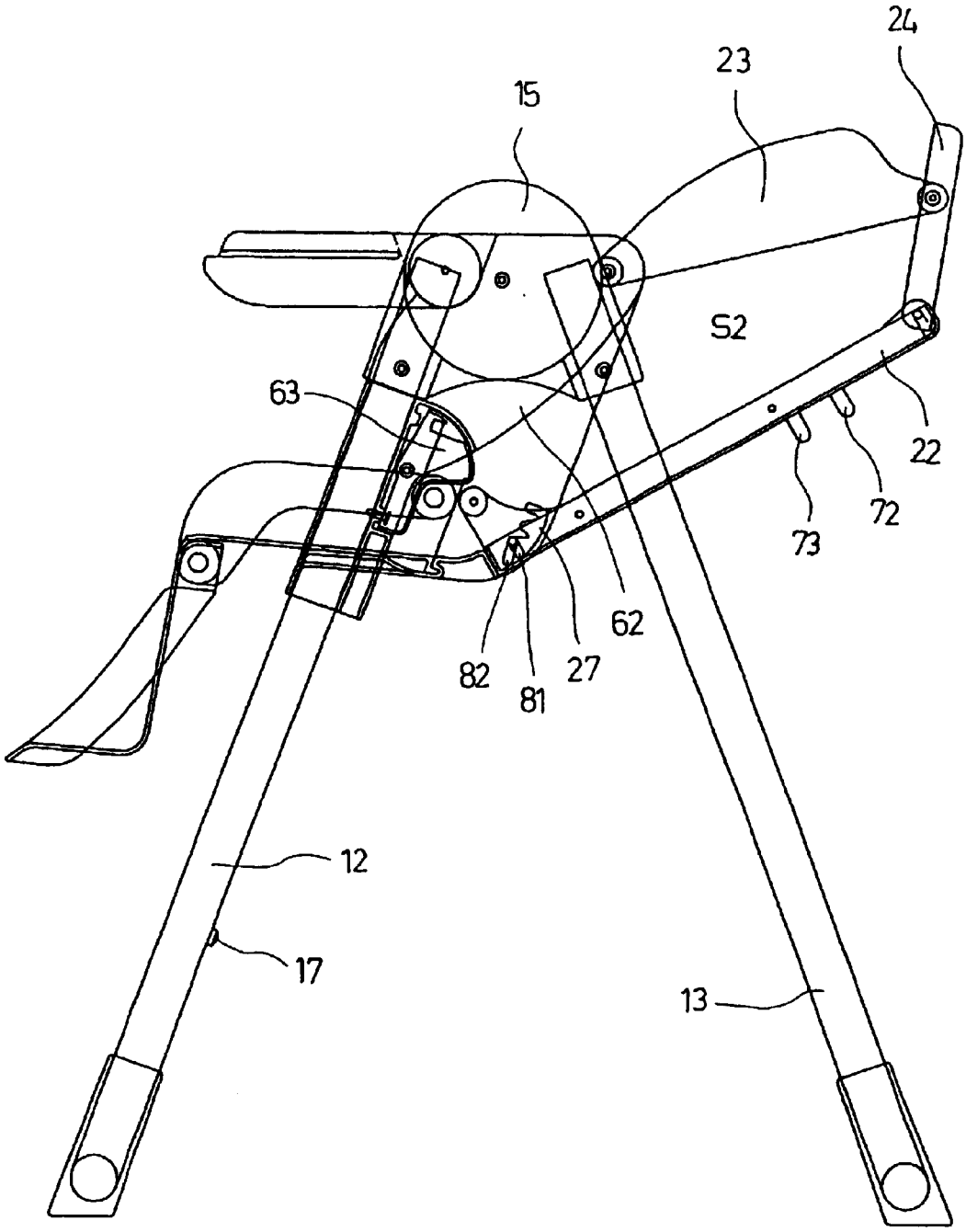
FIG. 7 is a side view of showing the structure of the high chair for infants, toddlers and small children in accordance with the present invention, in which the seat portion is in the highest height position and the backrest is in the third adjusting position.

FIG. 5 to FIG. 7 are side views for showing the structure of the high chair for infants, toddlers and small children, in which the seat portion 18 is in the highest height position and the backrest portion 21 is in the first, second and third adjusting positions, respectively.

The operation of the height-adjusting device 63 will be explained with reference to FIG. 2 to FIG. 7.

When the button 64 is in a normal state, the pin 67 is inserted into one of the positioning holes on the front leg 12 of the leg portion 11 so that the seat portion 18 is in a certain height position. When the button 64 is pressed, the front end of the movable sheet 66 is applied a force to move in a direction (the X direction in FIG. 2) with the back end thereof being moved in an opposed direction (the Y direction in FIG. 2), while the pin 67 fixed to the rear portion of the movable sheet 66 is then moved out of the positioning hole. At this moment, the height-adjusting device 63 can be moved along the front leg 12 of the leg portion 11 upwardly and downwardly so as to adjust the height position of the seat portion 18. When the height-adjusting device 63 is moved to a proper height position, the button 64 is released, the movable sheet 66 will be returned to the original position by the restoring force of the spring, and the pin 67 is then inserted into another positioning hole. Accordingly, the seat portion 18 is secured to the proper height position. In addition, as shown in FIGS. 2, 3 and 4, when the lower portion of the height-adjusting device and side panel portions 61 contacts the stopper component 17 in the front leg 12 of the leg portion 11, it means that the seat portion 18 of the high chair is adjusted to its lowest height position. When the upper portion of the height-adjusting device and side panel portions 61 reaches to the joining member 15, it means that the seat portion 18 of the high chair is adjusted to its highest height position, as shown in FIGS. 5, 6 and 7.

The operation of the backrest adjusting mechanism 71 will be explained with reference to FIG. 2 to FIG. 9.

Figures 8, 9:
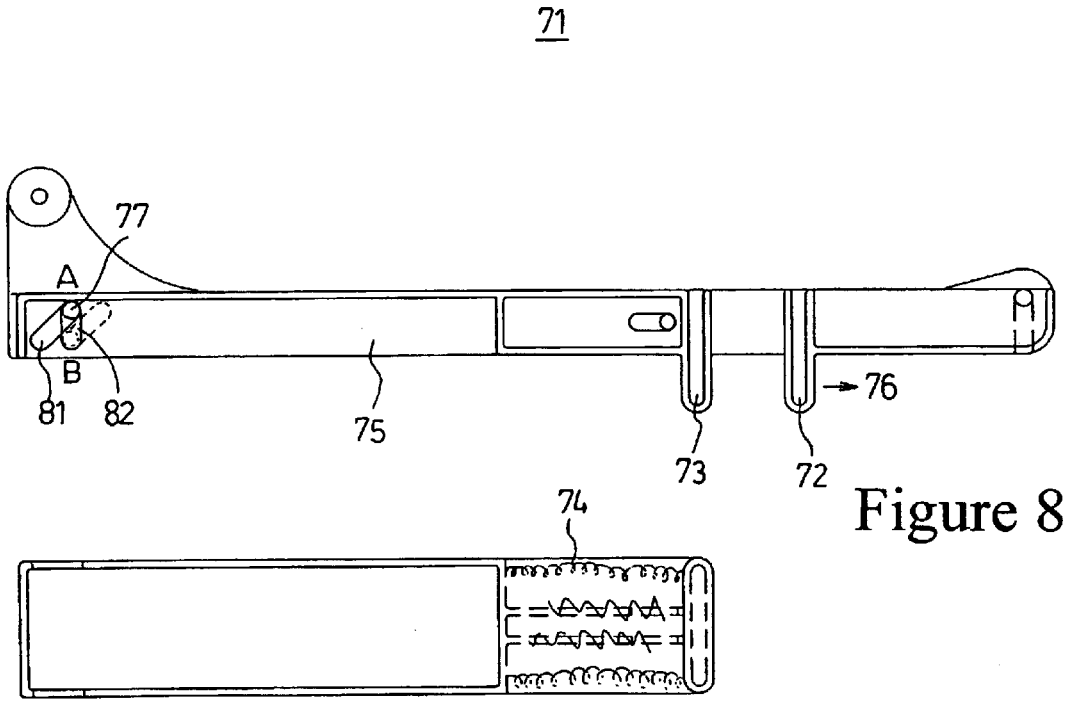
FIG. 8 is a side view of showing the structure of the backrest adjusting mechanism in accordance with the present invention.
FIG. 9 is a top view of showing the structure of the backrest adjusting mechanism in accordance with the present invention.

FIG. 8 and FIG. 9 are respectively a side view and a top view of showing the structure of the backrest adjusting mechanism in accordance with the present invention. In FIG. 8, the first groove 81 is formed in each of the two bottom sides of the movable rod of the backrest adjusting mechanism 71, and the second groove 82 is formed in each of the two bottom sides of the backrest body 22. The horizontal lever 77 penetrates through the bottom of the backrest body 22 and communicates to the first and second grooves 81 and 82. At first, in the case that the seat portion 18 is in the lowest height position, the backrest portion 21 of the high chair is in the first adjusting positions, i.e., the horizontal lever 77 is in the first position of the W-shaped locating slot 27 of the backrest body 22 as shown in FIG. 2. When the inclination angle of the backrest portion 21 is intended to be adjusted, the part of a hand between the thumb and the index finger leans on the fixed handle 72, and the other fingers hook over the movable handle 73 so that a force is applied to pull the movable handle 73 to move toward the direction 76 as indicated in FIG. 8. At this point, the movable rod 75 is moved toward the direction 76 due to the force applied, and the horizontal lever 77 is also moved downwardly from position A due to the force applied. At the same time, the first groove 81 in the movable rod 75 is moved toward the direction 76 by the movement of the movable rod 75. Finally, the horizontal lever 77 is moved from position A to position B, while the first groove 81 is moved to the position as indicated by the dash line in FIG. 8. At this moment, the movable handle 73 can be released when the backrest portion 21 of the high chair is adjusted to the second adjusting position. The movable rod 75 is moved in a direction opposite to the direction 76 due to the restoring force of the spring 74, and the relation between the horizontal lever 77 and the first and second grooves 81 and 82 is returned to the original state. The backrest portion 21 of the high chair is now fixed at the second adjusting position, that is, the horizontal lever 77 is in the second position of the W-shaped locating slot 27 of the backrest body 22 as shown in FIG. 3. Therefore, the backrest portion 21 of the high chair can be adjusted to a desired position by repeating the aforementioned operations. Similarly, the same operations can be applied to the case when the seat portion 18 is in the highest height position, as shown in FIGS. 5, 6 and 7.

In addition, with reference to FIGS. 2, 3 and 4, when the high chair 1 for infants, toddlers and small children in accordance with the present invention is adjusted from the first adjusting position to the second or third adjusting position, because the headrest panel 24 is pivotally connected to the top of the backrest body 22, one end of the backrest side panels 23 is connected to the side portion of the headrest panel 24, and the other end thereof is connected to the side panel of the height-adjusting device and side panel portion 61, a space (as indicated by S1 and S2 in FIGS. 3 and 4) will be naturally formed by the backrest body 22, the backrest side panels 23, the headrest panel 24, and the side panel portion 62. Such a space in connection with the backrest side panels 23 will enhance the protection effect on the infants, toddlers and small children so that the infants, toddlers and small children who are sitting or lying in the high chair can be protected not to turn over from the lateral side of the high chair. In the same manner, the same operations can be applied to the case that the seat portion 18 is in the highest height position, as shown in FIGS. 5, 6 and 7.

Figure 10:
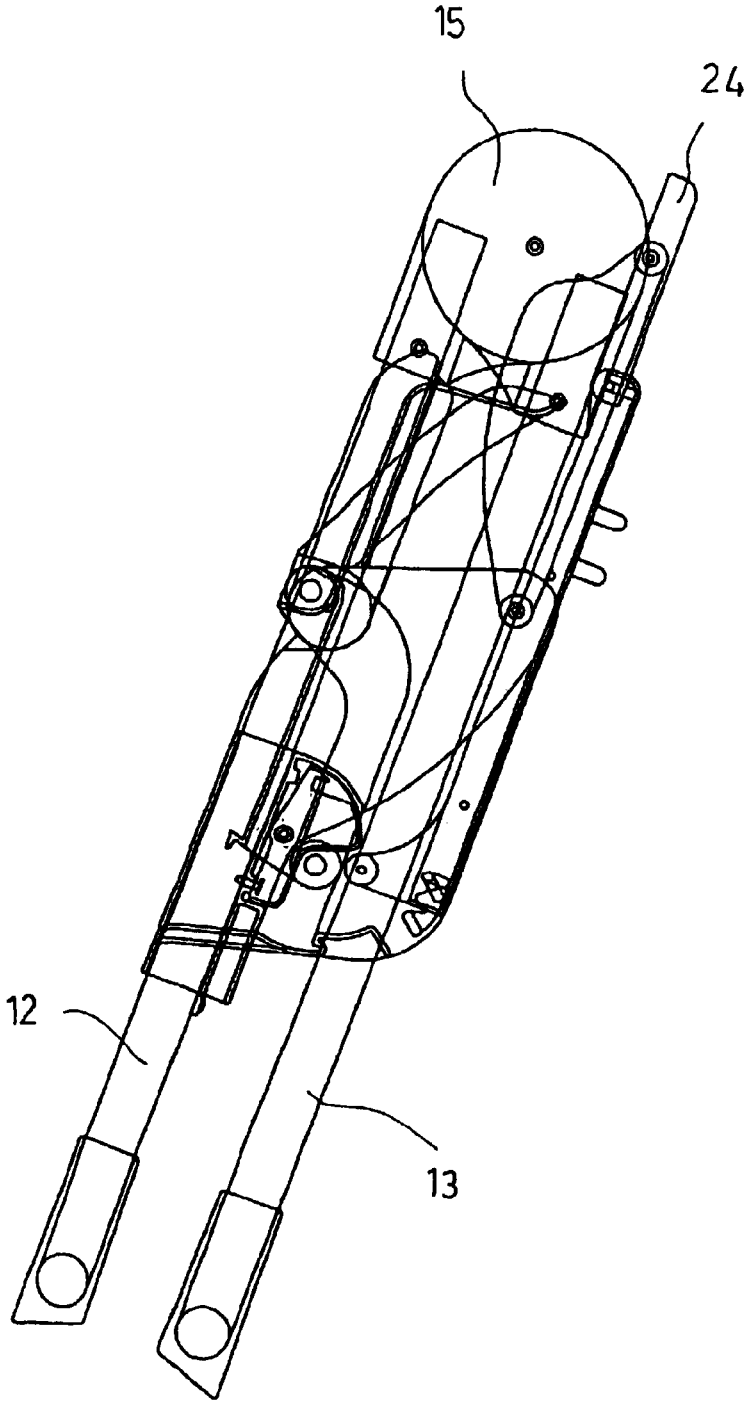
FIG. 10 is a side view of showing the structure of the high chair for infants, toddlers and small children in accordance with the present invention when it is completely retracted.

FIG. 10 is a side view of showing the structure of the high chair for infants, toddlers and small children in accordance with the present invention when it is completely retracted.

With reference to FIG. 10, the high chair 1 for infants, toddlers and small children in accordance with the present invention has a very small retraction size as compared with the conventional high chair for infants, toddlers and small children, which is in favor of the carry and the storage of the high chair.

Such a high chair produced in accordance with the present invention achieves the following functions.

(1) A function of adjusting the height of the seat portion can be achieved. This function can be carried out based on the operation of the height-adjusting device 63 of the high chair in accordance with the present invention. When the button 64 is in a normal state, the pin 67 is inserted into one of the positioning holes on the front leg 12 of the leg portion 11 so that the seat portion 18 is fixed at a certain height position. When the button 64 is pressed, the pin 67 is separated from the positioning hole at which it is fixed. At this moment, the seat portion 18 can be moved along the front leg 12 of the leg portion 11 upwardly and downwardly so as to adjust the height of the seat portion 18. Once the height-adjusting device 63 is moved to a proper height position, as long as the button 64 is released, the seat portion 18 can be fixed to this proper height position. Therefore, it is very simple and easy to perform the operation of adjusting the height of the seat portion of the high chair in accordance with the present invention.

(2) A function of adjusting the inclination angle of the backrest portion can be achieved. This function can be carried out based on the operation of the backrest adjusting mechanism 71 of the high chair in accordance with the present invention. When the inclination angle of the backrest portion 21 is intended to be adjusted, the movable handle 73 is pulled to jointly drag the movable rod 75 so that the horizontal lever 77 can be released from the position where it is previously held. At this point, the inclination angle of the backrest portion 21 can be adjusted. When the desired inclination angle is reached, the backrest portion 21 of the high chair can be easily fixed at this desired inclination position by simply releasing the movable handle 73. In this way, the backrest portion 21 of the high chair can be adjusted as desired.

(3) An additional protection function can be achieved. Because the headrest panel 24 is pivotally connected to the top of the backrest body 22, one end of the backrest side panels 23 is connected to the side portion of the headrest panel 24, and the other end thereof is connected to the side panel of the height-adjusting device and side panel portion 61, a space (as indicated by S1 and S2 in FIGS. 3 and 4) will be naturally formed when the backrest adjusting mechanism 71 is adjusted to the second and third adjusting position. Such a space in connection with the backrest side panels 23 will enhance the protection effect on the infants, toddlers and small children so that the infants, toddlers and small children who are sitting or lying in the high chair can be protected not to turn over from the lateral side of the high chair.

Therefore, as compared with the conventional high chair, the operation of the high chair for infants, toddlers and small children in accordance with the present invention is simple and labor-saving. The height of the seat portion can be adjusted upwardly and downwardly as desired simply by pressing the button of the height-adjusting device, and the adjustment of the inclination angle of the backrest portion 21 can be realized by gently pulling the movable handle of the backrest adjusting mechanism 71. In addition, the high chair for infants, toddlers and small children in accordance with the present invention has an additional protection function. With its compact retracting size, it is in favor of the carry and the portability of the high chair.

While the present invention has been described in detail and pictorially in the accompanying drawings, it is not limited to such details since many changes and modifications recognizable to those skilled in the art may be made to the invention without departing from the spirit and the scope thereof.

What is claimed is:

1. A high chair (1) for infants, toddlers and small children equipped with a backrest adjusting mechanism, comprising:

a leg portion (11) including a pair of front legs (12), a pair of rear legs (13), a pair of horizontal connecting members (14), and a set of joining members (15), wherein a plurality of positioning holes are formed in and a stopper component (17) is provided on each of the front legs for adjusting the height position of a seat portion of said high chair; and a seat portion (18) movably joined to said leg portion, comprising:

a pair of height-adjusting device and side panel portions (61) movably joined to a respective one of the front legs of the leg portion, and each of the height-adjusting device and side panel portions including a side panel portion (62) and a height-adjusting device (63) for adjusting the height position of the seat portion of the high chair;

a backrest portion (21) comprised of a backrest body (22) having two bottom sides, a pair of backrest side panels (23), and a headrest panel (24), wherein said headrest panel is pivotally connected to the top of the backrest body, one end of each of the backrest side panels is connected to a respective side of said headrest panel, and the other end of each of the backrest side panels is connected to a respective side panel of the height-adjusting device and side panel portions, and wherein a hollow section (25) is provided in the middle portion of the backrest body for the installation of the backrest adjusting mechanism, and a locating slot (27) is formed in each of the two bottom sides of the backrest body for adjusting the inclination angle of the backrest portion;

a seat body (31);

a foot rest (41) pivotally connected to a lower bending portion of the seat body;

a pair of arm rests (51), wherein one end of each of the arm rests is pivotally connected to one of the side panels of the height-adjusting device and side panel portions such that each of the arm rests can be moved upwardly for retraction; and a backrest adjusting mechanism (71) installed in the hollow section of the backrest body for adjusting the inclination angle of the backrest portion of the high chair.

2. A high chair for infants, toddlers and small children provided with a backrest adjusting mechanism as claimed in claim 1, wherein said height-adjusting device is comprised of a button (64), a fixed sheet (65), a movable sheet (66), a spring, and a pin (67), and wherein said pin is secured to the rear portion of the movable sheet, and said spring is connected between the fixed sheet and the movable sheet.

3. A high chair for infants, toddlers and small children provided with a backrest adjusting mechanism as claimed in claim 2, wherein said height-adjusting device (63) is operated by pressing the button such that the pin is separated from the positioning hole at which it is fixed, and whereby, said height-adjusting device can be moved along the front leg of the leg portion upwardly and downwardly so as to adjust the height of the seat portion of the high chair.

4. A backrest adjusting mechanism used in a high chair for infants, toddlers and small children and installed in the hollow section of the backrest body of the high chair as claimed in any of the claim 1, 2 or 3, including a fixed handle (72), a movable handle (73), a set of springs (74), a movable rod (75), and a horizontal lever (77) for adjusting the inclination angle of the backrest portion of the high chair, wherein said springs are connected between the movable rod and the movable handle, said backrest adjusting mechanism is characterized in that a first groove (81) is formed in each of the two bottom sides of the movable rod of the backrest adjusting mechanism, and a second groove (82) is formed in each of the two bottom sides of the backrest body, and said horizontal lever penetrates through the bottom of the backrest body and communicates to said first and second grooves, when the inclination angle of the backrest portion is intended to be adjusted, the movable handle is pulled to jointly drag the movable rod so that the horizontal lever can be released from the position where it is previously held, and at this point, the inclination angle of the backrest portion can be adjusted, and when the desired inclination angle is reached, the backrest portion of the high chair can be easily fixed at this desired inclination position by simply releasing the movable handle, whereby the backrest portion of the high chair can be adjusted at will.

5. A high chair for infants, toddlers and small children provided with a backrest adjusting mechanism as claimed in claim 1, wherein said backrest adjusting mechanism is comprised of a fixed handle (72), a movable handle (73), a set of springs (74), a movable rod (75), and a horizontal lever (77), wherein said springs are connected between the movable rod and the movable handle, and wherein a first groove (81) is formed in each of the two bottom sides of the movable rod of the backrest adjusting mechanism, and a second groove (82) is formed in each of the two bottom sides of the backrest body, and wherein said horizontal lever penetrates through the bottom of the backrest body and communicates to said first and second grooves.

6. A high chair for infants, toddlers and small children provided with a backrest adjusting mechanism as claimed in claim 5, wherein said backrest adjusting mechanism (71) is operated by pulling the movable handle to jointly drag the movable rod so that the horizontal lever can be released from the position where it is previously held, and whereby the inclination angle of the backrest portion of the high chair can be adjusted as desired.

7. A high chair for infants, toddlers and small children provided with a backrest adjusting mechanism as claimed in claim 6, further providing an additional protection function, which is because that the headrest panel is pivotally connected to the top of the backrest body, one end of each of the backrest side panels is connected to the respective side portion of the headrest panel, and the other end thereof is connected to the respective side panel of the height-adjusting device and side panel portion, an additional space (S1, S2) will be naturally formed when the backrest adjusting mechanism is adjusted to make the seat body more inclined, and such a space in connection with the backrest side panels will enhance the protection effect for preventing infants, toddlers and small children from turning over from the lateral side of the high chair.

8. A high chair for infants, toddlers and small children provided with a backrest adjusting mechanism as claimed in claim 1, wherein one end of each of said arm rests is formed with a guide groove (52) for receiving a tray (19) for placing foods and toys.

9. A high chair for infants, toddlers and small children provided with a backrest adjusting mechanism as claimed in claim 1, wherein said locating slot (27) formed in each of the two bottom sides of the backrest body is substantially in the form of an almost W shape with three stages of backrest adjusting angles.

* * * * *